US007118305B1

(12) United States Patent
Corbett

(10) Patent No.: US 7,118,305 B1
(45) Date of Patent: Oct. 10, 2006

(54) WAVE SHAPED VEHICLE BARRIER

(75) Inventor: Blaise L. Corbett, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/145,236

(22) Filed: May 23, 2005

(51) Int. Cl.
*E01F 15/00* (2006.01)

(52) U.S. Cl. ..... 404/6

(58) Field of Classification Search ..... 404/15, 404/35; 238/10 R, 14; 49/49; 405/25; D25/21
See application file for complete search history.

(56) References Cited

U.S. PATENT DOCUMENTS

| | | | | | |
|---|---|---|---|---|---|
| 1,502,123 | A | * | 7/1924 | Sall | 238/14 |
| 3,583,297 | A | * | 6/1971 | Udden | 404/71 |
| 3,918,638 | A | * | 11/1975 | Nelson | 238/14 |
| D242,718 | S | * | 12/1976 | Barr | D25/21 |
| 4,498,805 | A | * | 2/1985 | Weir | 405/31 |
| 4,759,655 | A | | 7/1988 | Gorlov | 404/6 |
| 4,780,020 | A | | 10/1988 | Terio | 404/6 |
| 4,818,137 | A | | 4/1989 | Gorlov | 404/6 |
| 4,913,595 | A | * | 4/1990 | Creter et al. | 405/30 |
| 4,998,843 | A | | 3/1991 | Mothe | 404/6 |
| 5,106,226 | A | * | 4/1992 | Fanslow et al. | 404/15 |
| 5,327,850 | A | * | 7/1994 | Sly et al. | 116/63 P |
| 5,392,728 | A | * | 2/1995 | Speer et al. | 116/63 R |
| 5,393,169 | A | * | 2/1995 | Creter | 405/25 |
| 5,515,807 | A | * | 5/1996 | Speer et al. | 116/63 R |
| 5,769,563 | A | * | 6/1998 | Flynn | 404/15 |
| 5,899,632 | A | | 5/1999 | Martin | 405/25 |
| 5,924,820 | A | * | 7/1999 | Creter | 405/25 |
| 6,672,799 | B1 | | 1/2004 | Earl | 405/111 |
| 2004/0028469 | A1 | | 2/2004 | Dehart | 404/6 |

* cited by examiner

*Primary Examiner*—Gary S. Hartmann
(74) *Attorney, Agent, or Firm*—Gerhard W. Thielman, Esq.; Scott R. Boalick, Esq.

(57) ABSTRACT

A vehicle barrier uses adjacent rows of wave-like sections adapted to be positioned on a ground surface. A section is defined by (i) a planar wall extending angularly upward from the ground surface to the section's peak, and (ii) a concave wall extending angularly downward from the section's peak to the ground surface.

30 Claims, 3 Drawing Sheets

WAVE SHAPED VEHICLE BARRIER

STATEMENT OF GOVERNMENT INTEREST

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to vehicle barriers, and more particularly to a wave shaped barrier capable of slowing or arresting a moving vehicle as the vehicle encounters the barrier.

BACKGROUND

Vehicle barriers made from concrete and steel reinforced concrete require planning, material construction, and heavy equipment to put in place. Once in place, it can be difficult to remove or to modify the size and shape of these barriers to meet changing mission protection requirements. Such changes include extending, shrinking, or moving a protection area. Using current barrier technology, entire sections might have to be destroyed to modify the protection area.

Concrete-based construction can also require extensive amounts of time and pre-deployment site activity thus allowing individuals with diverging social interests time to plan against this type of deployment. In addition, the weight of these heavy barriers may limit their use to a certain degree. For example, because of their weight, concrete-based barriers are frequently arranged along a single line. Thus, the barriers only offer a single line of defense that, if compromised, opens the "door" to easy vehicle entry.

SUMMARY

A vehicle barrier is described. The vehicle barrier provides multiple lines of defense against an oncoming vehicle. The vehicle barrier may be a modular vehicle barrier that can be quickly deployed and/or moved to accommodate changing protection needs.

In accordance with one implementation, a vehicle barrier includes one or more adjacent rows of wave-like sections adapted to be positioned on a ground surface. At least one section is defined by (i) a planar wall extending angularly upward from the ground surface to the section's peak, and (ii) a concave wall extending angularly downward from the section's peak to the ground surface.

Other implementations of the present invention will become more obvious hereinafter in the specification and drawings.

DETAILED DESCRIPTION

Figure 1:
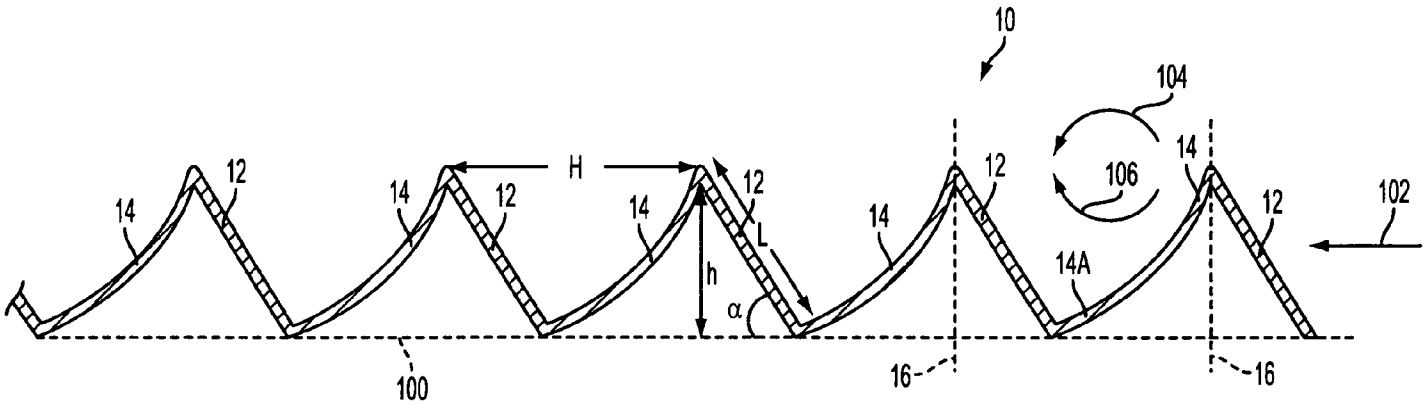
FIG. 1 is a cross-sectional view of one implementation of a multiple-section, wave shaped vehicle barrier.

Referring now to the drawings, and more particularly to FIG. 1, a cross-sectional view of a multiple-section vehicle barrier in accordance with one implementation of the present invention is shown and is referenced generally by numeral 10. In general, sections of barrier 10 are "wave" shaped such that a plurality of the sections arranged in an adjacent fashion resemble a series of contiguous waves with alternating peaks and valleys. More specifically, a section typically is defined by (i) a planar wall 12 that extends angularly upward from a wave valley to a wave peak, and (ii) a concave wall 14 that extends from the wave peak to a next successive wave valley. Thus, concave wall 14 is somewhat C-shaped and, for convenience, vehicle barrier 10 will be referred to herein as a "C-wave" barrier having multiple C-wave sections. The number of C-wave sections can be greater or less than that shown as long as at least two peak-valley-peak "trenches" are defined.

C-wave barrier 10 is positioned on a ground surface (referenced by dashed line 100) with the planar walls 12 thereof facing the direction of expected incoming vehicle traffic. In FIG. 1, the direction of expected incoming vehicle traffic is referenced by direction arrow 102. The width of C-wave barrier 10 (i.e., into and out of the paper) can be tailored to a specific application. For larger application widths, multiple C-wave barriers can be placed in a side-by-side relationship to form the desired width.

When C-wave barrier 10 is positioned in this fashion, a wheeled vehicle (not shown) would approach and encounter C-wave barrier 10 from direction 102. Assuming the vehicle has enough forward momentum to climb the first-encountered planar wall 12, the vehicle's front wheel(s) will become entrenched in the barrier's first peak-valley-peak trench defined between vertical dashed lines 16. With a vehicle traveling along direction 102, rotation of wheel(s) in trench 16 will be as indicated by directional arrow 104.

Figure 2B:
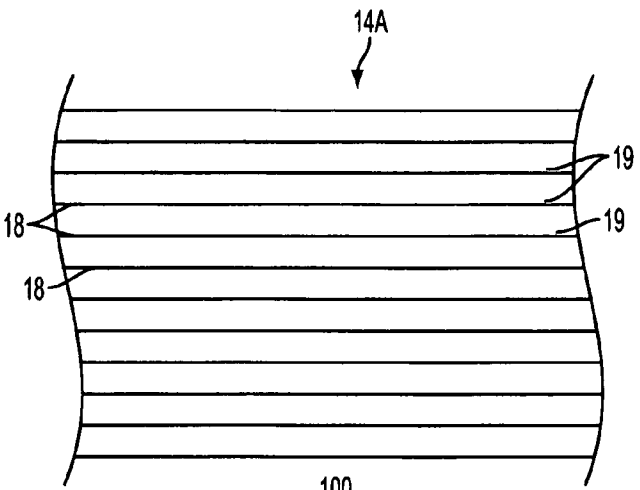
FIG. 2B is a head-on view of a portion of the grooved concave wall taken along line 2—2 in FIG. 2A.
Figure 2A:
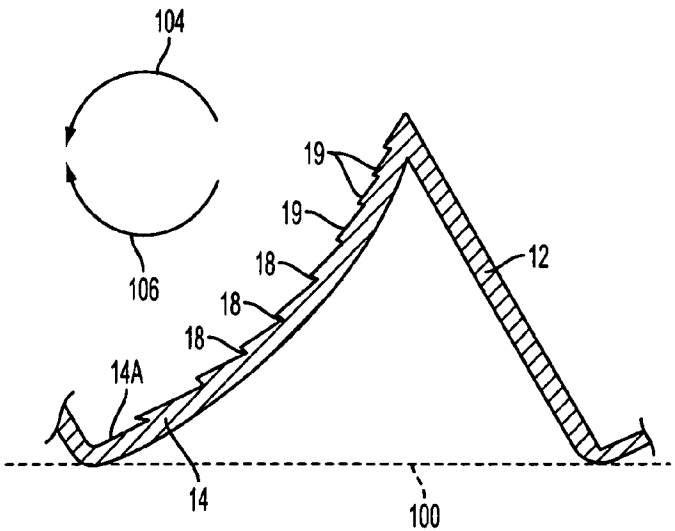
FIG. 2A is a cross-sectional view of an exemplary single wave shaped vehicle barrier section in which the exposed surface of the section's concave wall has grooves formed therein such that a stepped surface is defined.

The concave shape of concave wall 14 will tend to pull the wheel(s) deeper into the trench 16. This action can be enhanced if the exposed surface 14A of concave wall 14 presents an increased traction surface when wheel(s) are rotating in direction 104. For example, as illustrated in FIGS. 2A and 2B, surface 14A could have grooves 18 formed therein and extending along the width thereof, approximately parallel to ground surface 100. The shape of grooves 18 is selected such that wheel traction is enhanced when a wheel(s) are rotating in direction 104. For example, in the illustrated embodiment, grooves 18 are shaped such that steps 19 are formed on surface 14A. Furthermore, grooves 18 can be shaped to simultaneously reduce traction when wheel(s) are rotating in direction 106 opposite that of direction 104. In this way, if the rotational direction of entrenched wheel(s) were reversed to assume direction 106, the wheel(s) will be further arrested within trench 16. Assuming an oncoming vehicle had a great deal of forward momentum to get through or over the first section, C-wave barrier 10 presents a redundant system such that there is at least one additional C-wave section that would function as just described to slow or arrest a moving vehicle.

As illustrated in FIG. 1, exemplary C-wave barrier 10 uses identically-sized barrier sections that can be scaled for a variety of applications. As would be understood by one of ordinary skill in the art, such scaling can be simplified by judicious selection of angles (i.e., the angle that planar wall 12 makes with ground surface 100, the angles between planar wall 12 and concave wall 14 at the peaks and valleys, etc.), valley-to-valley lengths, and a radius-of-curvature of concave wall 14, to yield a standardized set of geometric design ratios. For example, one exemplary set of design ratios is as follows:

(i) a length L of planar wall 12 of 1.0 units at an angle $\alpha$ that is a minimum of 60°, (ii) a radius of curvature of concave wall 14 of 1.35 units, (iii) a peak-to-peak horizontal distance H of 1.35 units, and (iv) a peak height h of 0.88 units.

Figure 3:
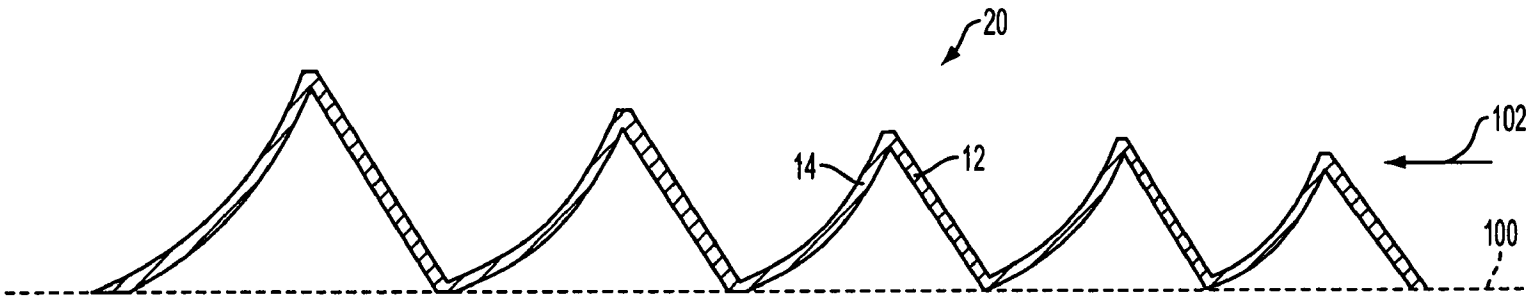
FIG. 3 is a cross-sectional view of another implementation of a multiple-section, wave shaped vehicle barrier constructed from wave sections of varying size.

However, it is to be understood that the present invention is not limited to these ratios or to the use of identically-sized barrier sections. For example, an exemplary C-wave barrier 20 shown in FIG. 3 utilizes progressively larger barrier sections when viewed along the expected direction 102 of an incoming vehicle.

Figure 4:
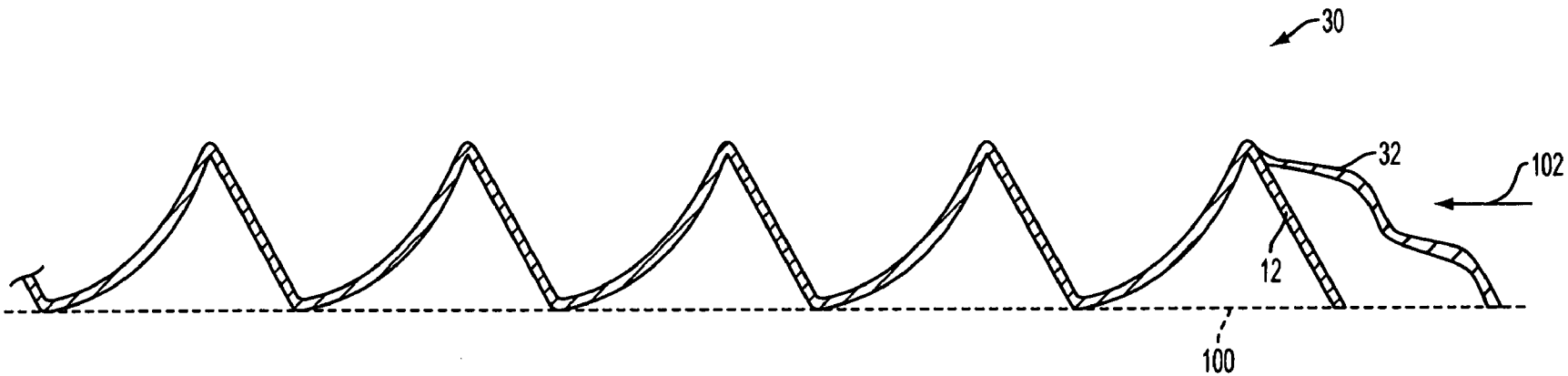
FIG. 4 is a cross-sectional view of another implementation of a multiple-section, wave shaped vehicle barrier having a contoured wall forming the leading wall of the barrier.

Another implementation of the present invention is illustrated in FIG. 4 where a C-wave barrier 30 is similar to barrier 10 described above. However, a leading wall 32 of C-wave barrier 30 is a non-planar, contoured wall designed to convert vehicle momentum in direction 102 to vertical movement thereby serving to "pop up" the vehicle's wheel (s) to assure entrenchment thereof in one of the barrier's trenches. It is to be understood that the particular contour of leading wall 32 is not a limitation of the present invention. Further, leading wall 32 can be added in various locations, such as on top of (as shown) or in place of the first planar wall 12.

A variety of methods can be used to construct the various C-wave barriers described herein. In one implementation, the barrier could be a solid structure (i.e., the spaces between the barrier's exposed surface and ground surface 100 would be filled with a solid material) permanently constructed from, for example, concrete poured and formed in-situ. In this type of construction, the sheer weight of the barrier would serve to anchor the barrier to the ground.

Figure 5:
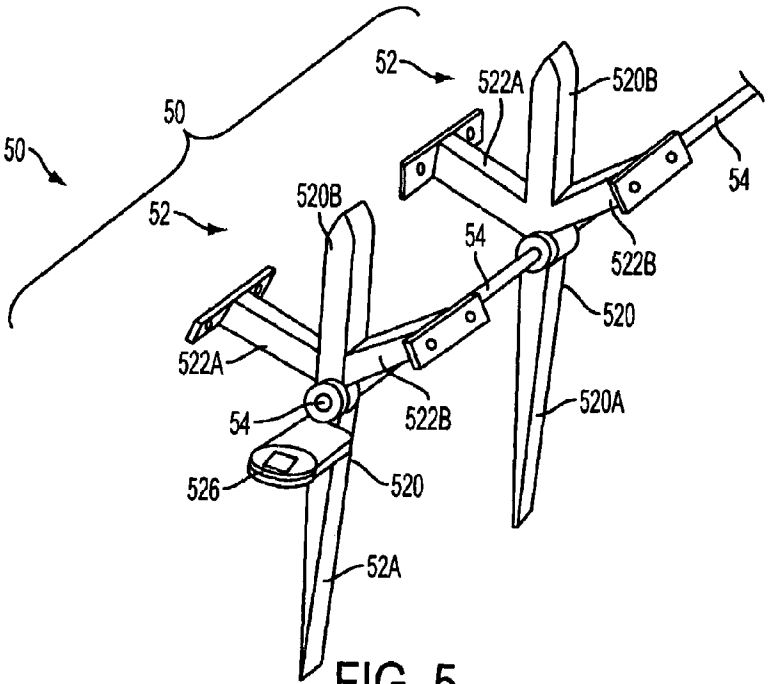
FIG. 5 is a perspective view of an implementation of an anchoring system that can be used to anchor a sheet material-based wave shaped vehicle barrier section to the ground.

The present invention also lends itself to a variety of easily transported and assembled components. For example, the barriers described herein could be made from rigid sheet(s) of metal such as aluminum plate, e.g., one continuous sheet formed into multiple C-wave sections, a separate sheet forming each C-wave section as a modular component of a C-wave barrier, a separate sheet for each planar wall 12 and a separate sheet for each concave wall 14 as modular elements of a C-wave section, etc. Since this type of barrier is considerably lighter than one made from solid concrete, it may need to be anchored to the ground. While a variety of such anchoring systems could be used, one such anchoring system 50 will be described by way of example with reference to FIG. 5.

Figure 6:
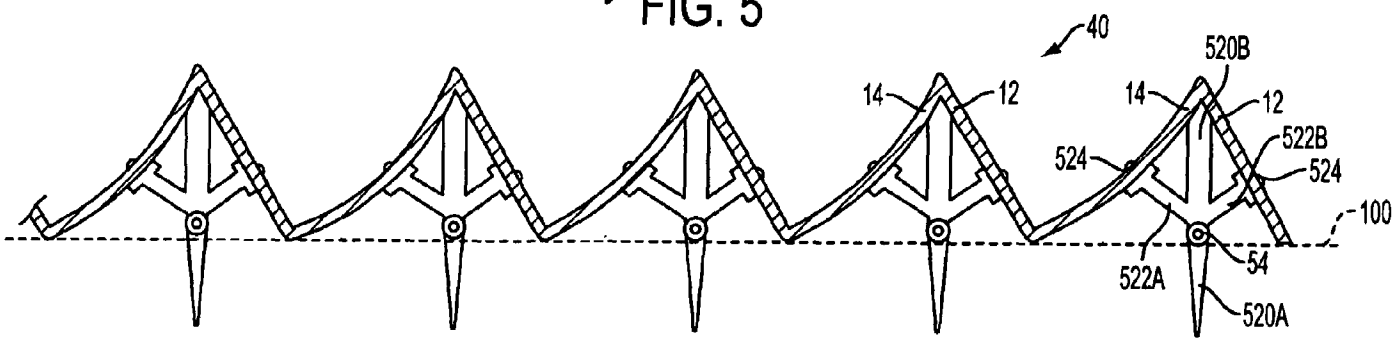
FIG. 6 is a side view of an exemplary multiple-section, wave shaped vehicle barrier anchored to the ground using the anchoring system illustrated in FIG. 5.

Anchoring system 50 will typically span the width of a C-wave barrier section and attach to planar wall 12 and concave wall 14 of each section thereof to form a complete C-wave barrier 40 illustrated in FIG. 6. Anchoring system 50 utilizes a plurality of "t" sections 52 spaced apart and coupled to one another by coupling rods 54. The number of, and spacing between, t-sections 52 is a design choice that is not a limitation of the present invention. The t-section 52 has a vertical member 520 with a lower portion 520A thereof designed to anchor t-section 52 into the ground. An upper portion 520B is sized and shaped to nest into the interior of a C-wave barrier section peak (FIG. 6). The t-section 52 also has left and right cross members 522A and 522B, respectively, that support and attach to a respective concave wall 14 and planar wall 12. Attachment can be made by conventional bolts 524 (FIG. 6) or by other suitable means. Those of t-sections 52 forming the outboard ends of anchoring system 50 can also be equipped with a coupling tab 526 that would be used to link an adjacent anchoring system 50 thereto.

The C-wave barrier provides a simple and efficient design for slowing and/or arresting an oncoming vehicle. The design lends itself to a variety of permanent and temporary constructions. Thus, the present invention can be adapted to a variety of applications and changing protection scenarios.

Although the invention has been described relative to specific implementations thereof, there are numerous variations and modifications that will be readily apparent to those skilled in the art in light of the above teachings. It is therefore to be understood that, within the scope of the appended claims, the invention may be practiced other than as specifically described.

I claim:

1. A vehicle barrier for inhibiting locomotion of an approaching vehicle, the barrier comprising a plurality of tandem adjacent rows of waveform sections disposable on a ground surface, each of the sections defined by (i) a planar wall extending angularly upward from the ground surface to a peak of the section to inhibit the vehicle from proceeding to an adjacent station on approach, and (ii) a concave wall extending angularly downward from the peak to the ground surface to inhibit the vehicle from reversing to the planar wall.

2. A vehicle barrier as in claim 1 wherein each concave wall has an exposed surface thereof that provides enhanced traction for a wheel rotating thereagainst in a first rotational direction while providing reduced traction for a wheel rotating thereagainst in a second rotational direction that is opposite to that of the first rotational direction.

3. A vehicle barrier as in claim 2 wherein the exposed surface has grooves formed therein that extend in a direction substantially parallel to the ground surface.

4. A vehicle barrier as in claim 1 further comprising a leading wall extending angularly upward from the ground surface to a peak of a first of the sections, the leading wall defining a non-planar surface for inducing vertical movement of a vehicle transitioning from the ground surface to the leading wall.

5. A vehicle barrier as in claim 1 further comprising means for anchoring the sections to the ground.

6. A vehicle barrier as in claim 5 wherein the means for anchoring is separable from the sections.

7. A vehicle barrier as in claim 5 wherein the means for anchoring is integral with the sections.

8. A vehicle barrier as in claim 1 wherein the sections are identically sized.

9. A vehicle barrier as in claim 1 wherein the sections vary in size.

10. A vehicle barrier as in claim 1 wherein the sections are formed from a single sheet of material.

11. A vehicle barrier as in claim 1 wherein the sections are formed as modular elements.

12. A vehicle barrier to inhibit locomotion of an approaching vehicle, the barrier comprising a plurality of tandem adjacent rows of waveform sections disposable on a ground surface, each section of the plurality defined by (i) a planar wall extending angularly upward from a valley of a preceding adjacent section to a peak of the each section to inhibit the vehicle from proceeding to a subsequent adjacent station on approach, and (ii) a concave wall extending angularly downward from the peak of the each section to a valley of the subsequent adjacent section to inhibit the vehicle from reversing to the planar wall.

13. A vehicle barrier as in claim 12 wherein each concave wall has an exposed surface thereof that provides enhanced traction for a wheel rotating thereagainst in a first rotational direction while providing reduced traction for a wheel rotating thereagainst in a second rotational direction that is opposite to that of the first rotational direction.

14. A vehicle barrier as in claim 13 wherein the exposed surface has grooves formed therein that extend in a direction substantially parallel to the ground surface.

15. A vehicle barrier as in claim 12 further comprising a leading wall extending angularly upward from the ground surface to a peak of a first of the sections, the leading wall defining a non-planar surface for inducing vertical movement of a vehicle transitioning from the ground surface to the leading wall.

16. A vehicle barrier as in claim 12 further comprising means for anchoring the sections to the ground.

17. A vehicle barrier as in claim 16 wherein the means for anchoring is separable from the sections.

18. A vehicle barrier as in claim 16 wherein the means for anchoring is integral with the sections.

19. A vehicle barrier as in claim 12 wherein the sections are identically size.

20. A vehicle barrier as in claim 12 wherein the sections vary in size.

21. A vehicle barrier as in claim 12 wherein the sections are formed from a single sheet of material.

22. A vehicle barrier as in claim 12 wherein the sections are formed as modular elements.

23. A vehicle barrier for inhibiting locomotion of an approaching vehicle, the barrier, comprising:

a plurality of tandem adjacent rows of waveform sections disposable on a ground surface, each section of the plurality defined by (i) a planar wall extending angularly upward from a valley of a preceding adjacent section to a peak of the each section to inhibit the vehicle from proceeding to a subsequent adjacent station on approach, and (ii) a concave wall extending angularly downward from the peak of the each section a valley of the subsequent adjacent section to inhibit the vehicle from reversing to the planar wall; and a plurality of anchoring supports, each support positioned beneath the each section and coupled thereto for supporting the sections and anchoring the sections to the ground.

24. A vehicle barrier as in claim 23 wherein each concave wall has an exposed surface thereof that provides enhanced traction for a wheel rotating thereagainst in a first rotational direction while providing reduced traction for a wheel rotating thereagainst in a second rotational direction that is opposite to that of the first rotational direction.

25. A vehicle barrier as in claim 24 wherein the exposed surface has grooves formed therein that extend in a direction substantially parallel to the ground surface.

26. A vehicle barrier as in claim 23 further comprising a leading wall extending angularly upward from the ground surface to a peak of a first of the sections, the leading wall defining a non-planar surface for inducing vertical movement of a vehicle transitioning from the ground surface to the leading wall.

27. A vehicle barrier as in claim 23 wherein the sections are identically sized.

28. A vehicle barrier as in claim 23 wherein the sections vary in size.

29. A vehicle barrier as in claim 23 wherein the sections are formed from a single sheet of material.

30. A vehicle barrier as in claim 23 wherein the sections are formed as modular elements.

* * * * *